United States Patent [19]

Stangl

[11] Patent Number: 4,502,615

[45] Date of Patent: Mar. 5, 1985

[54] APPARATUS FOR A CONTROLLED SUPPLY OF POWDER TO A MOLD FOR CONTINUOUS CASTING

[75] Inventor: Kurt Stangl, Seewalchen, Austria

[73] Assignee: Voest-Alpine Aktiengesellschaft, Linz, Austria

[21] Appl. No.: 415,484

[22] Filed: Sep. 7, 1982

[30] Foreign Application Priority Data

Oct. 5, 1981 [AT] Austria ..... 4246/81

[51] Int. Cl.[3] ..... B65G 27/100

[52] U.S. Cl. ..... 222/199; 222/310; 222/502; 164/473; 198/771

[58] Field of Search ..... 222/196, 200, 310, 502, 222/199; 198/752, 761, 771; 164/473; 118/308

[56] References Cited

U.S. PATENT DOCUMENTS

| | | | |
|---|---|---|---|
| 1,647,704 | 11/1927 | Lea | 198/502 |
| 1,702,525 | 2/1929 | Smith | 222/415 X |
| 1,752,549 | 4/1930 | Beardsley | 222/310 |
| 3,411,566 | 11/1968 | Astrov et al. | 164/473 X |
| 3,865,278 | 2/1975 | Gallati | 222/200 X |

FOREIGN PATENT DOCUMENTS

| | | | |
|---|---|---|---|
| 2263876 | 12/1972 | Fed. Rep. of Germany | 222/196 |
| 2425381 | 1/1975 | Fed. Rep. of Germany . | |
| 2814496 | 10/1979 | Fed. Rep. of Germany . | |
| 2833867 | 2/1980 | Fed. Rep. of Germany . | |
| 627520 | 6/1927 | France | 198/771 |

*Primary Examiner*—Joseph J. Rolla
*Assistant Examiner*—Frederick R. Handren
*Attorney, Agent, or Firm*—Kurt Kelman

[57] ABSTRACT

An apparatus for a controlled supply of a powder to a mold for continuous casting has a vibrating conveyor with a delivery edge and a retaining wall carried by the vibrating conveyor. The retaining wall extends along the delivery edge and defines a flow control gap therewith, the retaining wall causing the powder to pile up thereat and to exert a conveying pressure on the powder flowing through the gap. The flow control gap has a height varying in inverse relation to the conveying pressure.

6 Claims, 3 Drawing Figures

APPARATUS FOR A CONTROLLED SUPPLY OF POWDER TO A MOLD FOR CONTINUOUS CASTING

Figure 1:
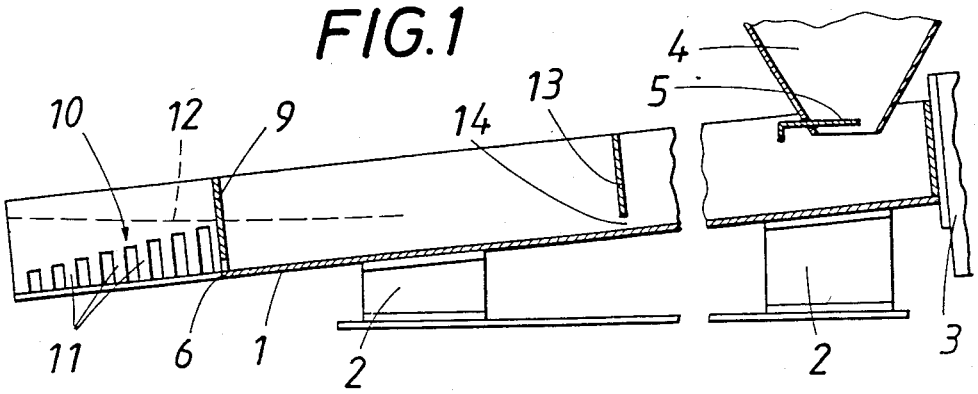

This invention relates to apparatus for a controlled supply of a powder to a mold for continuous casting, comprising a conveyor, which is adapted to remove powder from a powder supply container and has a delivery end portion provided with a delivery edge which has a configuration depending on the cross-sectional shape of the mold.

It is known from Laid-open German Applications Nos. 28 14 496 and 28 33 867 that a controlled supply of a powder to a mold for continuous casting can be effected by means of a pneumatic conveyor, which has a delivery bottom through which air is blown into the powder so that the same is fluidized and the flowability of the powder is thus changed. The rate at which powder is supplied to the mold by such pneumatic conveyor will depend on the degree to which the powder is fluidized. With the air supply rate, the powder supply rate can be controlled in dependence on the rate at which heat is radiated from the surface of the molten bath because the radiant heat is influenced by the height of the layer of the powder on the molten bath.

That known apparatus can be used to control the rate at which the powder is supplied but cannot be used to ensure a uniform distribution of said powder on the surface of the molten bath. Such control of the distribution would require a proper distribution along the delivery edge of the rate at which the powder is supplied. In dependence on the cross-sectional shape of the mold, the delivery edge has usually such a configuration that the powder trickles on the surface of the molten bath halfway between the immersion pipe for supplying the molten metal and the inside peripheral surface of the mold.

In another apparatus, which is known from Laid-open German Application No. 24 25 381, the distribution of the powder on the surface of the molten bath is measured, e.g., by means of radiation sensors, and in dependence on the distribution which has been ascertained the powder is supplied by means of a conveyor which comprises delivery passages that are movable over the surface of the molten bath. These delivery passages are connected to a vibrating conveyor, which effects a proper supply of the powder. As the rate at which the powder is supplied can also be controlled, a uniform distribution of the powder can be effected. But this requires an expensive control system, which is liable to be deranged.

It is an object of the invention to provide for the controlled supply of powder to a mold for continuous casting an apparatus by which a desired distribution of the powder on the surface of the molten bath can be ensured with simple means.

In apparatus of the kind described first hereinbefore this object is accomplished with a conveyor consisting of a vibrating conveyor which carries a retaining wall that extends along the delivery edge and defines with the delivery edge a flow control gap of a height that varies along the flow control gap in dependence on the distribution of the conveying pressure acting on the powder adjacent to the flow control gap and tending to force the powder through the gap.

By a control of the amplitude of vibration of a conventional vibrating amplifier, it is possible to control in a simple manner the rate at which the material handled is conveyed but it is not possible to control in that way the distribution of the material along a delivery edge which includes different angles with the direction in which the material is delivered across said delivery edge. For this reason, such a vibrating conveyor apparently cannot be used to accomplish the object mentioned hereinbefore. But if a retaining wall is provided, which extends along and defines a flow control gap with the delivery edge, a controlled delivery of the powder throughout the length of the flow control gap can be obtained if the width of each portion of the gap is selected in dependence on the conveying pressure acting on the powder adjacent to the portion of the gap. That conveying pressure will depend on the dynamic conveying force exerted by the vibrating conveyor and on the static load applied to the powder by the overlying powder which has been retained by the retaining wall and tends to force the underlying powder laterally through the flow control gap. For this reason, powder can be supplied to the bath surface at an equal rate even in a plurality of delivery edge portions which extend in the direction of conveyance of the vibrating conveyor. On the other hand, the contribution of the overlying powder to the conveying pressure acting on the powder at the flow control gap is smaller than the dynamic pressure applied to the powder at the flow control gap by the vibrating conveyor at those portions of the delivery edge which are at right angles to the conveying direction. This results in different conditions along the flow control gap and the height of the flow control gap must be adjustable in order to compensate these differences. As the height of the powder layer which is retained by the retaining wall increases, the height of the flow control gap will have to be decreased. A smaller angle between the direction of conveyance of the vibrating conveyor and the delivery edge will result in a lower conveying pressure in the direction in which the powder flows through the flow control gap so that a larger height of the flow control gap will be required in that case if a uniform distribution of the delivery rate along the length of the delivery edge is to be ensured. It will be understood that the distribution of the conveying pressure along the flow control gap will be significant in the first place because the conveying pressure and the delivery rate depend on the amplitude of vibration of the vibrating conveyor and are independent of the distribution of the conveying pressure.

In order to ensure a uniform delivery of the powder throughout the length of the delivery edge, a uniform distribution of the flow rate of the powder throughout the width of the vibrating conveyor is required. Even in relatively short vibrating conveyors, such a uniform distribution of the flow rate of the powder throughout the width of the vibrating conveyor can be obtained if an additional retaining wall is provided upstream of the delivery edge and extends transversely to the direction of conveyance and defines with the vibrating conveyor a flow control gap of uniform height. That upstream flow control gap will ensure that the powder forms on the vibrating conveyor a layer of uniform thickness throughout the width of the vibrating conveyor even if the thickness of the layer varies before the upstream flow control gap.

As the powder to be delivered to molds for continuous casting is usually highly flowable, it can usually be delivered at the desired rate through gaps having a very small width so that even slight variations of the height of the gap will disturb the desired distribution of the rate at which the powder is delivered. This result can be avoided in a simple manner by dividing the flow control gap at the delivery edge by vertical webs, which are similar to teeth of a comb, so that slight deviations in the height of the gap will have only slight effects. Besides, the webs which are similar to teeth of a comb substantially contribute to the retaining action; this will have a desirable influence on the uniform distribution of the rate at which the powder is delivered across the delivery edge.

To permit an adaptation to varying conditions or to irregularities in the operation of the vibrating conveyor, for instance, to vibration patterns, the height of the flow control gap adjacent to the delivery edge may be adjustable, e.g., by the provision of tongues, which are adjustably mounted in the retaining wall. This will permit a subsequent adjustment by which all influences are taken into account.

Figure 2:
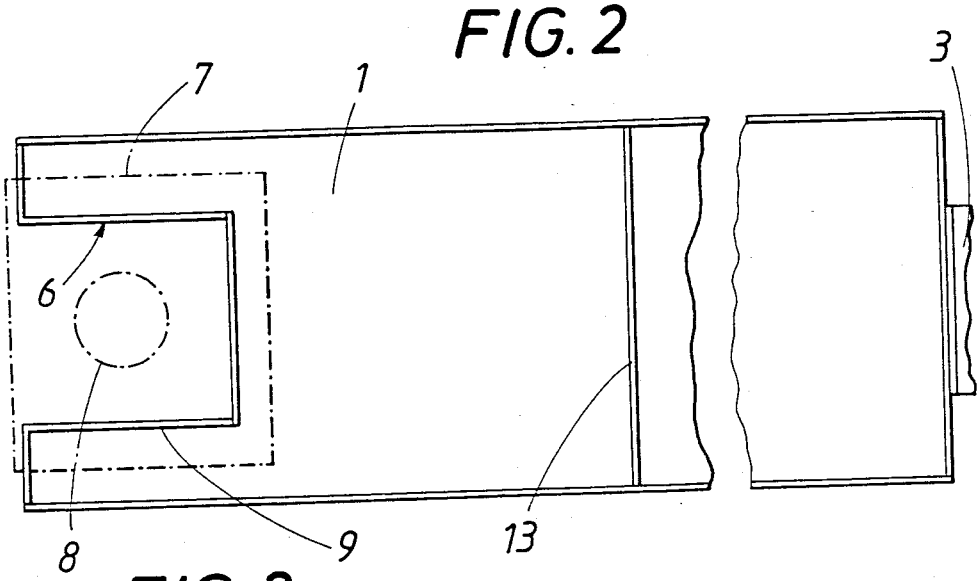
Figure 3:
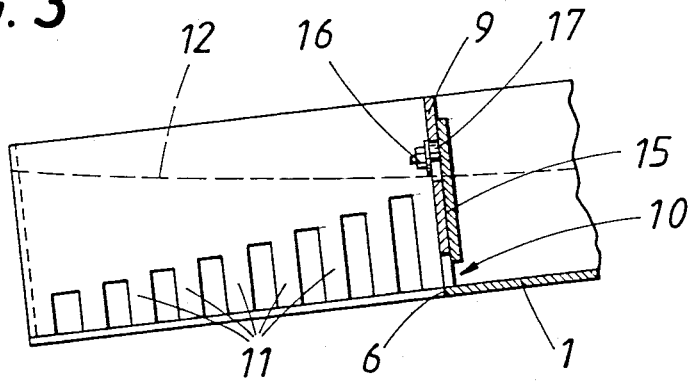

The invention is shown by way of example on the drawings, in which:

FIG. 1 is a longitudinal sectional view showing apparatus according to the invention for a controlled supply of powder to a mold for continuous casting, FIG. 2 is a top plan view showing that apparatus and FIG. 3 is an enlarged transverse sectional view showing the retaining wall provided at the delivery edge.

The apparatus shown in FIGS. 1 and 2 for a controlled supply of powder to a mold for continuous casting comprises a vibrating conveyor 1, which is supported by spring elements 2 and connected to a vibrator 3. At its receiving end, the vibrating conveyor 1 is connected to a powder hopper 4 and a gate valve 5 is provided for controlling the rate at which powder is taken from the hopper 4.

At its delivery end, the vibrating conveyor 1 is provided with a delivery edge 6, which has a configuration selected in accordance with the cross-sectional shape of the mold to which the powder is to be supplied. The contour of the mold is indicated in FIG. 2 by a dash-dot line 7. FIG. 2 shows also the position of the immersion pipe 8 for delivering molten metal to the mold 7. The delivery edge 6 has such a configuration that the powder is supplied to the surface of the molten bath in the square mold 7 on three sides approximately halfway between the inside peripheral surface of the mold and the immersion pipe 8 so that the powder can be uniformly distributed on the surface of the molten bath along three sides thereof. But this will not be possible unless the distribution of the flow rate of the powder along the length of the delivery edge is properly controlled.

This is ensured by retaining wall 9 carried by vibrating conveyor 1, which extends along the delivery edge 6 and defines with the latter a flow control gap 10. In the embodiment shown by way of example, gap 10 is divided into sections by vertical webs 11, which are similar to teeth of a comb. It is clearly apparent from FIGS. 1 and 3 that the height of the flow control gap varies along the length of the delivery edge. Specifically, the height of the flow control gap 10 varies in inverse relation to the height of the powder retained at the retaining wall 9. This is indicated in FIG. 3 by a dash line 12, which indicates the top edge of the layer formed by the powder conveyed toward the retaining wall 9. The height of the flow control gap depends not only on the height of the powder layer and on the distribution of that height but also on the angle included by the delivery edge 6 with the direction of conveyance by the vibrating conveyor 1. The conveying force acting in the conveying direction will obviously apply to the powder a higher pressure in the direction of flow through the flow control gap in a region in which the retaining wall is at right angles to the direction of conveyance than in a region in which the retaining wall includes an acute angle with that direction of conveyance. For this reason, the effect of the weight of the overlying powder will predominate in those regions in which the retaining wall extends generally in the direction of conveyance and will tend to force the powder through the adjacent portions of the flow control gap 10. This is taken into account by the different heights of different portions of the gap. The distribution of the conveying pressure over the length of the delivery edge 6 is preferably empirically determined.

To ensure that the desired distribution of the delivery rate throughout the length of the delivery edge will be obtained, a uniform distribution of the powder throughout the width of the vibrating conveyor 1 must be ensured. This can be ensured in a simple manner by the provision of an additional retaining wall 13, which is disposed upstream of the delivery edge 6 of the vibrating conveyor and defines a flow control gap 14, which has a constant width, which is preferably adjustable.

In accordance with FIG. 3, the retaining wall 9 is provided with tongues 15, which are adjustable in height and protrude toward the flow control gap 10. With these tongues the height of the flow control gap can be adjusted at least in certain length portions for adaptation to different conditions. In a simple arrangement, each tongue 15 is fixed to the retaining wall 9 by a clamp screw 16, which extends through a generally vertically slot 17 in the retaining wall 9 and can be loosened to permit an adjustment of the tongue 15.

What is claimed is:

1. In an apparatus for a controlled supply of a powder to a mold for continuous casting, the mold having a predetermined cross section and the apparatus comprising an inclined vibrating conveyor adapted to receive said powder at an upper region thereof and operable to convey said powder in a predetermined direction of conveyance to a lower delivery edge conforming to the cross section of the mold, the improvement comprising a retaining wall carried by said vibrating conveyor, the retaining wall extending along said delivery edge and defining a flow control gap therewith, the retaining wall having sections thereof oriented differently with respect to said predetermined direction and causing the powder to pile up thereat and to exert a conveying pressure on the powder flowing through the gap, which pressure varies at different retaining wall sections depending upon the orientation of the sections, and the flow control gap having a height varying in inverse relation to the conveying pressure.

2. In the apparatus of claim 1, an additional retaining wall carried by said vibrating conveyor upstream of the delivery edge, the additional retaining wall extending transversely to the direction of conveyance and defining a flow control gap of constant height therewith, and means for delivering said powder to the vibrating conveyor upstream of the additional retaining wall.

3. In the apparatus of claim 1, wherein the retaining wall has vertical webs spaced apart along said flow control gap to divide the gap into separate sections of different heights.

4. In the apparatus of claim 1, adjustable means for varying the height of the flow control gap in different sections thereof.

5. In an apparatus for a controlled supply of a powder to a mold for continuous casting, the mold having a predetermined cross section and the apparatus comprising an inclined vibrating conveyor adapted to receive said powder at an upper region thereof and operable to convey said powder in a predetermined direction of conveyance to a lower delivery edge conforming to the cross section of the mold, the improvement comprising a retaining wall carried by said vibrating conveyor, the retaining wall extending along said delivery edge and defining a flow control gap therewith, the retaining wall having sections thereof oriented differently with respect to said predetermined direction and causing the powder to pile up thereat and to exert a conveying pressure on the powder flowing through the gap, which pressure varies at different retaining wall sections depending upon the orientation of the sections, and the flow control gap having a height varying in inverse relation to the conveying pressure, tongues being mounted on said retaining wall, the tongues being spaced along said flow control gap and being adjustable to vary the height of said flow control gap in different sections thereof.

6. In an apparatus for a controlled supply of a powder to a mold for continuous casting, the mold having a predetermined cross section and the apparatus comprising an inclined vibrating conveyor adapted to receive said powder at an upper region thereof and operable to convey said powder in a predetermined direction of conveyance to a lower delivery edge conforming to the cross section of the mold, the delivery edge having a first portion extending generally at right angles to said direction of conveyance and a second portion extending generally in the direction of conveyance, the improvement comprising a retaining wall carried by said vibrating conveyor, the retaining wall extending along said delivery edge and defining a flow control gap therewith, the retaining wall causing the powder to pile up thereat and to exert a conveying pressure on the powder flowing through the gap, which pressure is different at the first and second portions of the delivery edge, and the flow control gap having a height varying in inverse relation to the conveying pressure, the height of the flow control gap being smaller along the first delivery edge portion than along the second delivery edge portion.

* * * * *